US006843463B1

(12) United States Patent
McWhorter et al.

(10) Patent No.: US 6,843,463 B1
(45) Date of Patent: Jan. 18, 2005

(54) PRESSURE REGULATED SLIP RAM ON A COIL TUBING BLOWOUT PREVENTER

(75) Inventors: David J. McWhorter, Magnolia, TX (US); Perry Lee McClanahan, Willis, TX (US)

(73) Assignee: Varco I/P/ Inc., Houston, TX (US)

( * ) Notice: Subject to any disclaimer, the term of this patent is extended or adjusted under 35 U.S.C. 154(b) by 116 days.

(21) Appl. No.: 10/232,457

(22) Filed: Aug. 30, 2002

(51) Int. Cl.[7] ..... E21B 33/06
(52) U.S. Cl. ..... 251/1.1; 137/601.2; 166/85.4
(58) Field of Search ..... 257/1.1, 1.2, 1.3; 137/601.2, 613; 91/443; 166/75.14, 85.4, 84.4

(56) References Cited

U.S. PATENT DOCUMENTS 3,695,349 A * 10/1972 Murman et al. ..... 166/84.4
4,515,211 A * 5/1985 Reed et al. ..... 166/77.1
4,676,312 A * 6/1987 Mosing et al. ..... 166/77.53
5,400,857 A * 3/1995 Whitby et al. ..... 251/1.3
5,515,926 A * 5/1996 Boychuk ..... 166/88.3
5,590,867 A * 1/1997 Van Winkle ..... 251/1.3
5,653,418 A * 8/1997 Olson ..... 251/1.3
5,694,975 A * 12/1997 Eidsmore ..... 251/64
6,145,594 A * 11/2000 Jones ..... 166/95.1
6,276,451 B1 * 8/2001 Funk ..... 166/85.4
6,655,405 B2 * 12/2003 Hollister et al. ..... 251/1.1

* cited by examiner

*Primary Examiner*—John Bastianelli
(74) *Attorney, Agent, or Firm*—Law Office of Tim Cook P.C.

(57) ABSTRACT

A blowout preventer for coiled tubing includes a pressure regulator for a slip ram so that the coiled tubing can be held firmly without exceeding the yield strength of the coiled tubing material and without damaging the coiled tubing.

13 Claims, 3 Drawing Sheets

PRESSURE REGULATED SLIP RAM ON A COIL TUBING BLOWOUT PREVENTER

FIELD OF THE INVENTION

The present invention relates generally to the field of blowout preventers (BOPs) and, more particularly, to a pressure regulated slip ram in a BOP used with coil tubing.

BACKGROUND OF THE INVENTION

In recent years, coil tubing has been used in downhole operations with greater and greater frequency and for a greater variety of jobs. Also, coil tubing has found application for operations at ever increasing depths. All of these factors have led to the use of large sizes of coil tubing. Coil tubing of greater diameter and wall thickness, as well as the greater length, requires sturdier and more robust BOPs at the well head when used with coil tubing.

The use of BOPs in coil tubing operations in the oil and gas field is well know. Such blowout preventers generally include a housing with a bore extending through the housing. Opposed chambers extend laterally of the bore in the housing and communicate with the bore. Rams are positioned in the chambers and the rams are connected to rods that are supported for moving the rams inwardly into the bore to close off the bore. This action divides the bore into a zone above the rams and a zone below the rams. The rods also serve to retract outwardly from the bore to open the bore.

Various types of rams may be employed such as those which engage circumferentially around the coil tubing for sealing engagement with the tubing, while others are provided with cutting surfaces for shearing the tubing which extends through the bore of the blowout preventer.

Among other uses, BOPs are commonly used in coiled tubing systems as a means of holding the tubing and isolating the well bore pressure during a variety of conditions, including emergencies. The configuration of the BOP rams and side port facility allow well-control operations to conducted under a variety of conditions.

Newer blowout preventers include four sets of rams, which may be referred to herein as a "Quad BOP". The system comprises a set of four stacked elements, each with a different function. Blind rams are shut when there is no tubing extending through the body of the BOP. Shear rams are designed to close on and cut through the tubing. Slip rams close on and hold the tubing, ideally without damaging the surface of the tubing member. Finally, pipe rams seal around the tubing when it is in place.

BOPs used at the wellhead for heavy walled drill pipe, for example, commonly use complex pressure regulations systems to control hydraulic control pressure to each of the rams in the BOP. However, such is not the case with BOPs used with coil tubing. In the art today, a single source of hydraulic actuation fluid at a single pressure is typically applied to all of the rams in the BOP. Further, the ram requiting the greatest pressure is the shear ram, and thus shear ram pressure is typically applied to all the rams in the BOP. With larger and heavier coil tubing, using higher shear ram pressure, this fact presents a problem when a lighter gage coil tubing is run into the hole. Applying the higher hydraulic actuation pressure to a slip ram to simply hold the tubing in place has been found to score or otherwise damage the coil tubing.

Although slip rams ideally do not damage the tubing surface of the tubular member through th BOP, it has been found that even a single actuation of the slips against the tubing can score the exterior surface of the tubing. In today's high performance operations at elevated pressures, this scoring can reduce the useful lifetime of the coil tubing. Thus, there remains a need for a means for applying a lower actuation pressure to a slip ram, while retaining the availability of the higher hydraulic pressure for the shear rams. Such a means should be simple, reliable, adjustable, and robust.

SUMMARY OF THE INVENTION

The present invention addresses these and other needs in the art by providing a retrofit or new construction pressure regulator for the slip ram of the BOP. The pressure regulator assembly can be easily bolted directly onto the existing BOP, or it can be built into the body of the BOP at the time of the construction of the BOP.

The pressure regulator receives high pressure hydraulic actuation fluid, at a pressure sufficient to actuate a shear ram, and reduces the pressure to a manually selectable lower pressure. An operator, knowing the outside diameter, yield strength, and wall thickness of the coil tubing, can then manually adjust the pressure regulator to provide a slip ram holding pressure at below the yield strength of the tubing without damaging the coil tubing.

These and other features of the invention will be apparent to those skilled in the art from a review of the following detailed description.

DETAILED DESCRIPTION OF A PREFERRED EMBODIMENT

Figure 1:
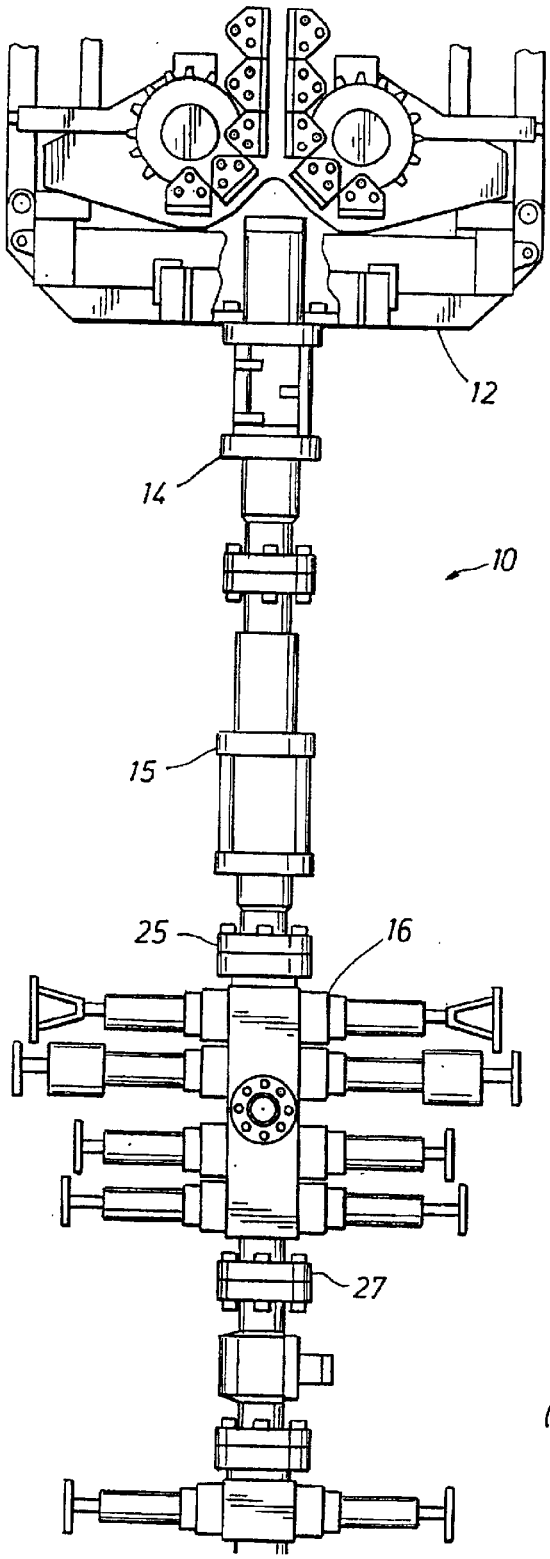
FIG.1 (PRIOR ART)
FIG. 1 is a side elevation view of a well head stack typically used in coil tubing operations.

FIG. 1 illustrates a typical, known wellhead stack 10 including a coil tubing injector 12, a top or primary stripper/packer 14, a secondary stripper/packer 15, and a BOP 16, all coupled together at the wellhead. For coiled tubing operations, the assembly also typically includes a depth counter (not shown) in physical contact with the coiled tubing as it is run into and out of the stack 10 to keep track of the length of coiled tubing down hole. It is vitally important, while withdrawing coiled tubing from the stack, to stop the coiled tubing while it is still within the second stripper/packer 15 but above the level of the BOP 16 to prevent an uncontrolled release of well fluids through the stack.

Figure 2:
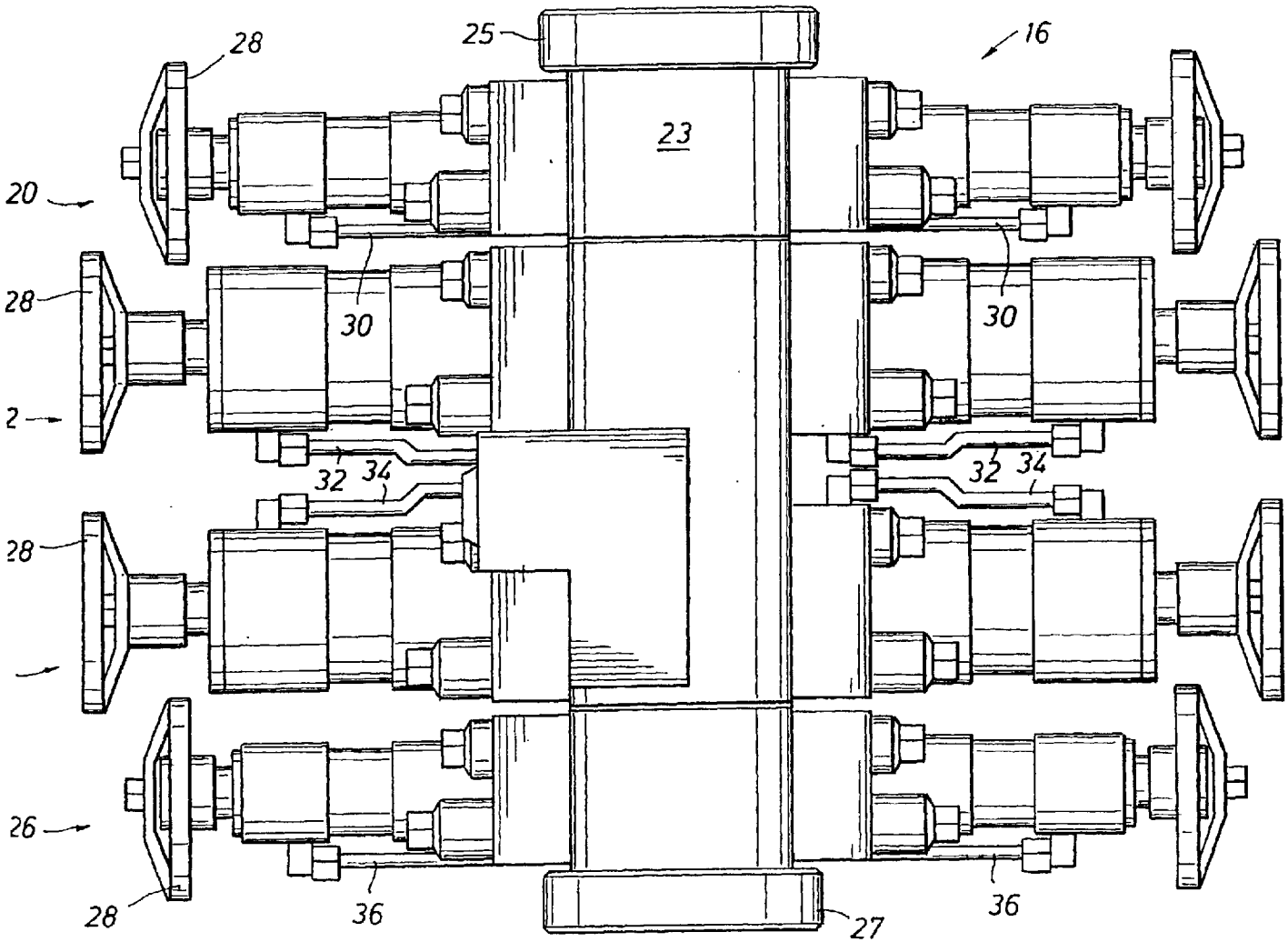
FIG. 2 is a side elevation view of a quad BOP in accordance with the present invention with a pressure regulator assembly installed.

FIG. 2 illustrates further details of the BOP 16. The top of the four sets of rams typically comprises blind rams 20, then sequentially downward are the shear rams 22, the slip rams 24, and the pipe rams 26. In a Quad BOP stack, the rams are positioned one on top of the other as a BOP body 23, which has a flanged connection 25 on top and another flanged connection 27 on the bottom for connection into the system as shown in FIG. 1. The body 23 defines a bore therethrough (not shown) to receive the coiled tubing.

Each of the rams 20, 22, 24, and 26 is provided with a manual actuator 28 for manual operation. However, routine operation of the rams 20, 22, 24, and 26 involves the application of hydraulic fluid under pressure through a selected pair of hydraulic lines 30, 32, 34, or 36, respectively. Unfortunately, application of high pressure hydraulic fluid, sufficient to actuate a set of shear rams 22, can result in damage to coiled tubing when applied to the slip rams 24.

To solve this problem, the present invention provides a manually adjustable pressure regulator assembly 40 which is coupled to the BOP at the slip rams 24. The pressure regulator assembly preferably includes a pressure regulator 41 (FIG. 3), which may be an ARO-#6521780-BIB-B, available from Hapeco, or other appropriate pressure regulator assembly. The pressure regulator assembly 40 also includes a check valve 44, which ports hydraulic fluid around the regulator 41 during opening operations on a slip ram assembly 46. Also, the pressure regulator is provided with a manual adjustment 48, in order to accommodate various sizes and wall thicknesses of coiled tubing.

Figure 3:
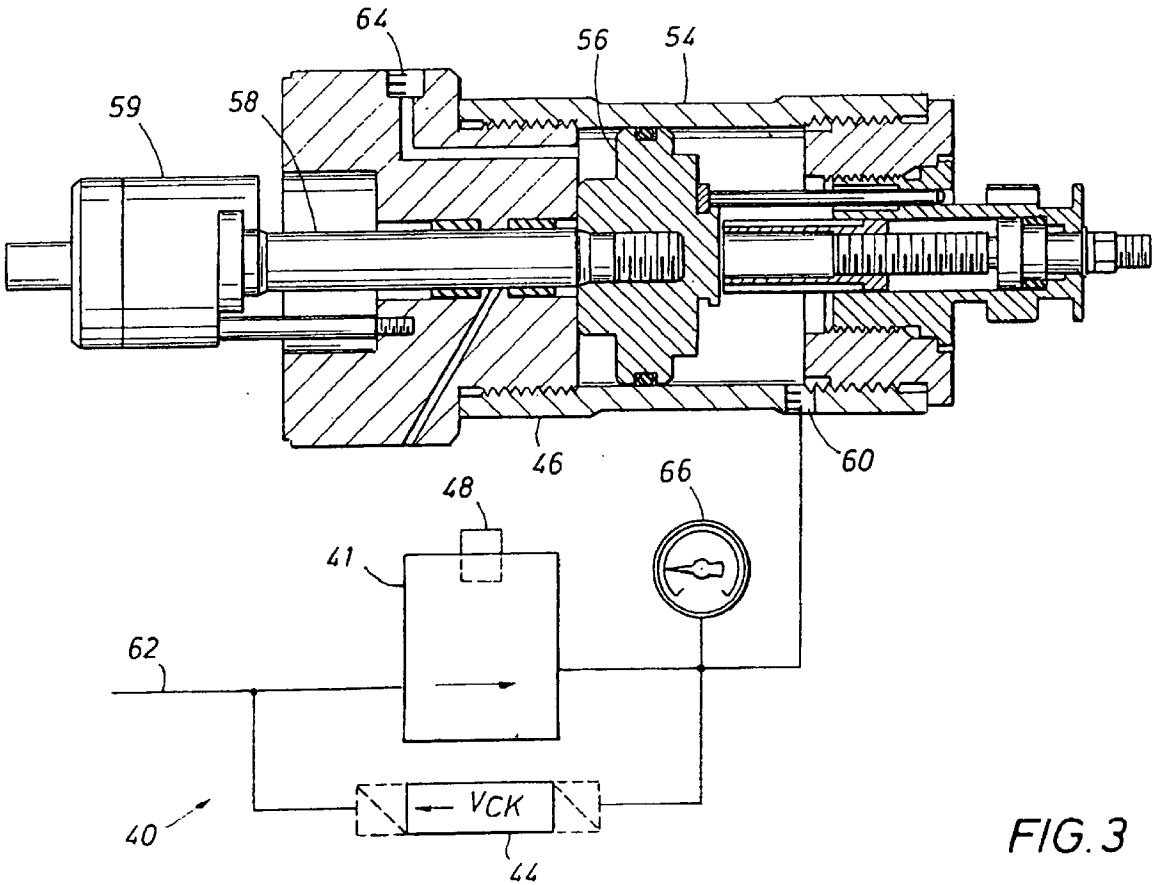
FIG. 3 is a side section view of a slip ram shown in section with a pressure regulator shown schematically.

As shown in FIG. 3, the slip ram assembly 46 comprises a body or cylinder 54, a piston 56 within the cylinder 54, and a stem or piston rod 58 joined to the slip ram. A slip ram 59 is joined to the rod 58 and is adapted to surround a tubular through the slip ram assembly. The slip ram assembly is actuated by hydraulic pressure being applied to a close port 60, in the present invention at a pressure set by the manual adjustment 48 which is lower than the pressure at a "close hydraulic in" supply line 62. The close hydraulic in supply line also supplies hydraulic fluid at high pressure to the shear rams 22 via supply lines 32 (See FIG. 2). The slip ram 59 is released by porting pressure to an open port 64 at full hydraulic pressure. Finally, a pressure gauge 66 is installed between the pressure regulator 41 and the close port 60 is order to monitor the pressure supplied to the slip ram. This provides the advantage of being able to set the desired pressure on the regulator 41 to accommodate different sizes and wall thicknesses of coiled tubing or other tubulars through the BOP, without damaging the tubular.

It will be apparent to those of skill in the BOP art that the present invention provides the advantage of ease of installation to existing BOPs. The pressure regulated slip ram actuator of this invention could also be made integral to the BOP stack upon initial construction.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A slip ram assembly for a BOP, the BOP including a shear ram actuated by hydraulic pressure supplied by a close hydraulic in supply line, adapted for coiled tubing operations, the slip ram assembly comprising:

a. a cylinder;

b. a piston within the cylinder;

c. a piston rod coupled to the piston;

d. a slip ram coupled to the piston rod;

e. an open port into the cylinder to open the slip ram;

f. a close port into the cylinder to close the slip ram;

g. a source of hydraulic fluid pressure defined by the close hydraulic in supply line; and h. a pressure regulator between the close hydraulic in supply line and the close port, thereby providing a hydraulic pressure for closing the slip ram that is lower than the close hydraulic in supply pressure.

2. The slip ram assembly of claim 1, further comprising a check valve to bypass the pressure regulator during opening operations on the slip ram.

3. The slip ram assembly of claim 1, further comprising a bidirectional pressure regulator into the close port permitting fluid flow into and out of the close port.

4. The slip ram assembly of claim 1, further comprising means of manually adjusting the outlet pressure of the pressure regulator.

5. The slip ram of claim 1, further comprising a pressure gauge between the pressure regulator and the close port.

6. A blowout preventer comprising:

a. a shear ram;

b. a slip ram;

c. a source of hydraulic fluid pressure adapted to operate the shear ram and the slip ram; and d. a pressure regulator between the source of hydraulic fluid and the slip ram, the regulator adapted to alter the pressure from the source to the slip ram, thereby providing a hydraulic pressure for closing the slip ram that is lower than the hydraulic pressure for closing the shear ram.

7. The blowout preventer of claim 6, further comprising a check valve to bypass the pressure regulator during opening operations on the slip ram.

8. The blowout preventer of claim 6, further comprising means of manually adjusting the outlet pressure of the pressure regulator.

9. The blowout preventer of claim 6, further comprising a pressure gauge between the pressure regulator and the slip ram.

10. The blowout preventer of claim 8, wherein the means of manually adjusting the outlet pressure of the pressure regulator accommodates different sizes and wall thicknesses of tubulars through the blowout preventer.

11. The blowout preventer of claim 8, wherein the means of manually adjusting the outlet pressure of the pressure regulator accommodates different sizes and wall thicknesses of coiled tubing through the blowout preventer.

12. A method of actuating a blowout preventer having a shear ram and a slip ram, comprising the steps of:

a. actuating the shear ram at a first hydraulic pressure;

b. shutting the slip ram at a second hydraulic pressure which is lower than the first hydraulic pressure.

13. The method of claim 12, wherein the shear ram is actuated from a source of hydraulic pressure and the slip ram is actuated from the same source of hydraulic pressure with a pressure regulator between the source of hydraulic pressure and the slip ram.

* * * * *